US009641946B2

(12) United States Patent
Launer et al.

(10) Patent No.: US 9,641,946 B2
(45) Date of Patent: May 2, 2017

(54) BINAURAL HEARING DEVICE AND METHOD TO OPERATE THE HEARING DEVICE

(71) Applicant: Phonak AG

(72) Inventors: Stefan Launer, Zurich (CH); Nail Cadalli, Ankara (TR); Silvia Allegro-Baumann, Unterageri (CH)

(73) Assignee: SONOVA AG, Staefa (CH)

( * ) Notice: Subject to any disclaimer, the term of this patent is extended or adjusted under 35 U.S.C. 154(b) by 408 days.

(21) Appl. No.: 13/660,082

(22) Filed: Oct. 25, 2012

(65) Prior Publication Data

US 2013/0108058 A1 May 2, 2013

(30) Foreign Application Priority Data

Nov. 1, 2011 (EP) ..... 11187385

(51) Int. Cl.
*H04R 25/00* (2006.01)

(52) U.S. Cl.
CPC ..... *H04R 25/556* (2013.01); *H04R 25/552* (2013.01); *H04R 25/554* (2013.01); *H04R 2225/41* (2013.01)

(58) Field of Classification Search
CPC .. H04R 25/552; H04R 25/407; H04R 25/554; H04R 2460/03; H04R 25/305; H04R 2225/41; H04R 2225/61; H04R 25/50; H04R 25/55; H04L 12/28; H04L 1/18; H04L 2001/0097; H04W 56/002;
(Continued)

(56) References Cited

U.S. PATENT DOCUMENTS 4,531,229 A * 7/1985 Coulter ..... 381/23.1
5,267,321 A * 11/1993 Langberg ..... 381/72
5,479,522 A * 12/1995 Lindemann et al. ..... 381/23.1
(Continued)

FOREIGN PATENT DOCUMENTS

WO 97/14268 A1 4/1997
WO 2008/052576 A1 5/2008
WO 2008/089784 A1 7/2008

OTHER PUBLICATIONS

European Search Report for 11 18 7385 dated Mar. 7, 2012.

*Primary Examiner* — Davetta W Goins
*Assistant Examiner* — Phylesha Dabney
(74) *Attorney, Agent, or Firm* — Pearne & Gordon LLP

(57) ABSTRACT

A hearing device is proposed comprising at least one microphone (1), at least one analog-to-digital converter (2), a signal processing unit (3), a communication unit (6) for establishing and/or maintaining a communication link to a second hearing device, and a detection unit (7) for determining a communication link quality. The at least one microphone (1) is operationally connected to the signal processing unit (3) via the at least one analog-to-digital converter (2), and the communication unit (6) is operationally connected to the signal processing unit (3). By providing said detection unit (7), which is operationally connected to the communication unit (6), together with a processing scheme selectable in the signal processing unit (3) in accordance to a determined communication link quality, a binaural hearing system with two hearing devices is for able to adjust its mode in line with the communication link quality, and therewith its capacity.

14 Claims, 2 Drawing Sheets

(58) Field of Classification Search
CPC . H04W 52/10; H04W 52/245; H04W 52/265; H04W 52/52
USPC ..... 381/23.1, 68, 300, 306, 318, 315; 455/66.1, 67.11; 370/329
See application file for complete search history.

(56) References Cited

U.S. PATENT DOCUMENTS

| | | | | |
|---|---|---|---|---|
| 5,553,151 | A * | 9/1996 | Goldberg | 381/312 |
| 6,353,671 | B1 * | 3/2002 | Kandel et al. | 381/318 |
| 6,434,246 | B1 * | 8/2002 | Kates et al. | 381/312 |
| 6,643,378 | B2 * | 11/2003 | Schumaier | 381/326 |
| 7,630,507 | B2 * | 12/2009 | Kates | 381/312 |
| 2002/0094099 | A1 * | 7/2002 | Kandel et al. | 381/312 |
| 2005/0100182 | A1 | 5/2005 | Sykes et al. | |
| 2005/0141733 | A1 * | 6/2005 | Blamey et al. | 381/312 |
| 2006/0093172 | A1 * | 5/2006 | Ludvigsen et al. | 381/315 |
| 2009/0154743 | A1 * | 6/2009 | Lundh et al. | 381/312 |
| 2009/0196445 | A1 * | 8/2009 | Elmedyb et al. | 381/318 |

* cited by examiner

BINAURAL HEARING DEVICE AND METHOD TO OPERATE THE HEARING DEVICE

TECHNICAL FIELD

The present invention is related to a hearing device according to the pre-characterizing part of claim 1, to a binaural hearing system as well as to a method to operate a binaural hearing system.

BACKGROUND OF THE INVENTION

Currently, most hearing devices include means for classifying the acoustic environment or acoustic scene. Some disclosures even include classifying schemes that incorporate features only available in binaural hearing systems, such as spatial localization of sound sources. The results of this classification process are then used to select the best processing scheme or the best set of parameter values for a processing scheme that is implemented in a signal processor in the hearing device.

An international patent application having publication number WO 97/14268 discloses a digital hearing aid system including two hearing aids interconnected via a communication link. The user of the hearing aid system is given the option of selecting a digital filter/compressor from a number of available filters/compressors that generate binaural signals that are then sent to one or both ears of the user. The audio signals picked up by the respective microphones are exchanged via the communication link so that full information is available in each of the two hearing devices. As long as the communication link is working properly, the hearing aid system is performing as desired.

SUMMARY OF THE INVENTION

It is an object of the present invention to improve the operation of a binaural hearing system.

This and other objects are reached by the features given in claim 1. Further embodiments as well as a binaural hearing system and a method to operate the binaural hearing system are given in further claims.

A hearing device according to the present invention comprises at least one microphone, at least one analog-to-digital converter, a signal processing unit and a communication unit that is provided for establishing and/or maintaining a communication link to a second hearing device. The at least one microphone is operationally connected to the signal processing unit via the at least one analog-to-digital converter. Furthermore, the communication unit is operationally connected to the signal processing unit. By providing a detection unit for determining a communication link quality, which detection unit is operationally connected to the communication unit, and a processing scheme being selectable in the signal processing unit in accordance to a determined communication link quality, a binaural hearing system with two hearing devices is able to adjust its mode in line with the communication link quality, and therewith its capacity.

The communication link, also called "binaural link", can sometimes be unstable, noisy or totally down due to a weak battery power, placement of the instruments, or strong electro-magnetic interference (EMI). Depending on the prevailing communication link conditions only a certain amount of information can be conveyed error-free. Therefore, it is proposed by the present invention that the actual information rate should be adapted dynamically to the existing quality of the communication link. At the same time, the operating mode of the hearing device is adapted to a momentary information rate via the communication link. While the communication link quality degrades gradually or abruptly under adverse conditions, it might still be possible to maintain a reduced information rate even though the signal-to-noise ratio (SNR) is low. As a result thereof, the information received from the contra-lateral hearing device might not be sufficient to operate the hearing device in a binaural mode, but instead rather in a bilateral mode or even in a monaural mode. These modes will be further explained below.

In a further embodiment of the present invention, a control strategy is proposed in that the hearing system is set into different operational modes depending on a momentary acoustic scene that is automatically detected by a classification scheme. Such a binaural hearing system additionally incorporates a sound classification unit and an intelligence unit that controls the operation of all the algorithms in the hearing system depending on the sound classification results and, possibly, the condition of the communication link. Also such a hearing system can be set, for example, to a binaural, a bilateral or a monaural operational mode based on the analysis of the sound received by the hearing system microphones.

BRIEF DESCRIPTION OF THE DRAWINGS

The present invention is further described by referring to drawings showing exemplified embodiments of the present invention. It is shown in FIG. 1 a block diagram of a first embodiment of a hearing device as part of a binaural hearing system according to the present invention;

FIG. 3 partially, a block diagram of yet another embodiment of a hearing device according to the present invention.

DETAILED DESCRIPTION OF THE INVENTION

In the following, the terms "contra-lateral" and "ipsilateral" are used to describe the different relationships between two hearing devices forming a binaural hearing system, in particular one hearing device to be worn on the right side (i.e. right ear) and another hearing device to be worn on the left side (i.e. left ear). The mentioned terms refer to a reference plane defined by the median plane of a bilateral structure which is the human body, for example.

Figure 1:
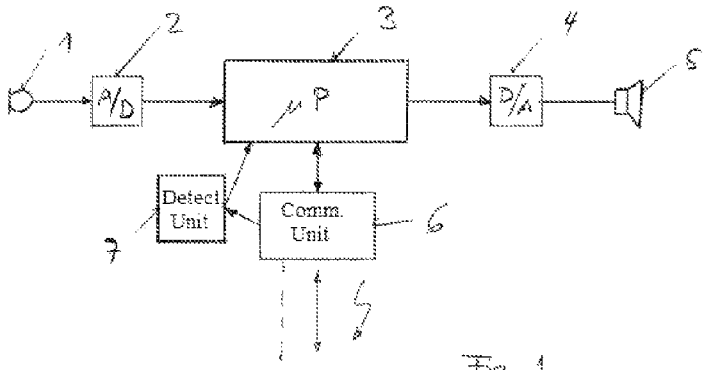

FIG. 1 shows a block diagram of a first embodiment of the present invention. In particular, FIG. 1 shows a hearing device as part of a binaural hearing system generally comprising two such hearing devices. The hearing device comprises a microphone 1, an analog-to-digital converter 2, a digital signal processor unit 3, a digital-to-analog converter 4, a receiver 5, a communication unit 6 and a detection unit 7. The main signal path consists of the microphone 1, the analog-to-digital converter 2, the signal processing unit 3, the digital-to-analog converter 4 and the receiver 5. These units are operationally connected in sequence as it is generally known. Furthermore, a communication unit 6 and a detection unit 7 are provided, the communication unit 6 being operationally connected to the signal processing unit 3. The communication unit 6 is further operationally connected to a second hearing device via a wired or a wireless communication link, the second hearing device being identically designed as the one depicted in FIG. 1, for example. The detection unit 7 is operationally connected to the communication unit 6 as well as to the signal processing unit 3 and is provided to observe or detect the quality of the communication link between the two hearing devices.

Given the structure described above, a binaural hearing system comprising two hearing devices is provided, in which an operating mode is selectable in accordance with the detected or observed quality of the communication link. The possible operating modes are, for example, a binaural operating mode, which is characterized by processing ipsi-lateral and contra-lateral audio signals picked up by the corresponding hearing devices, a bilateral operating mode, which is characterized by processing ipsi-lateral audio signals picked up by the ipsi-lateral hearing device as well as features obtained by processing contra-lateral audio signals in the contra-lateral hearing device, and a monaural operating mode, which is characterized by only processing audio signals of the respective hearing device. The meaning of the different operating modes and its processes will become more apparent by describing further embodiments of the present invention.

Figure 2:
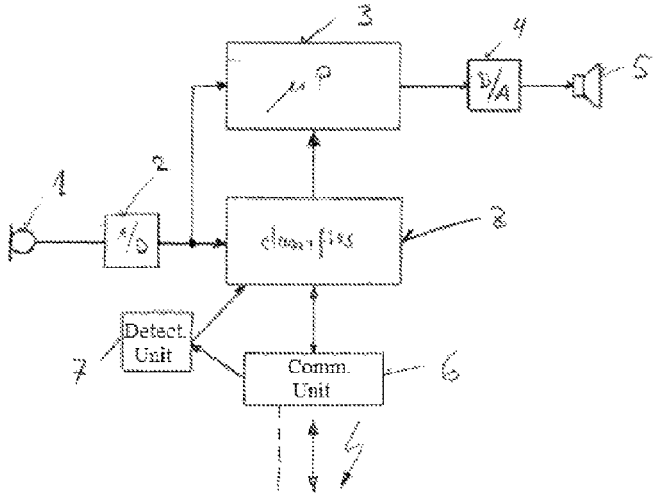
FIG. 2 a block diagram of a second embodiment of a hearing device as part of a binaural hearing system according to the present invention.
Figure 2:
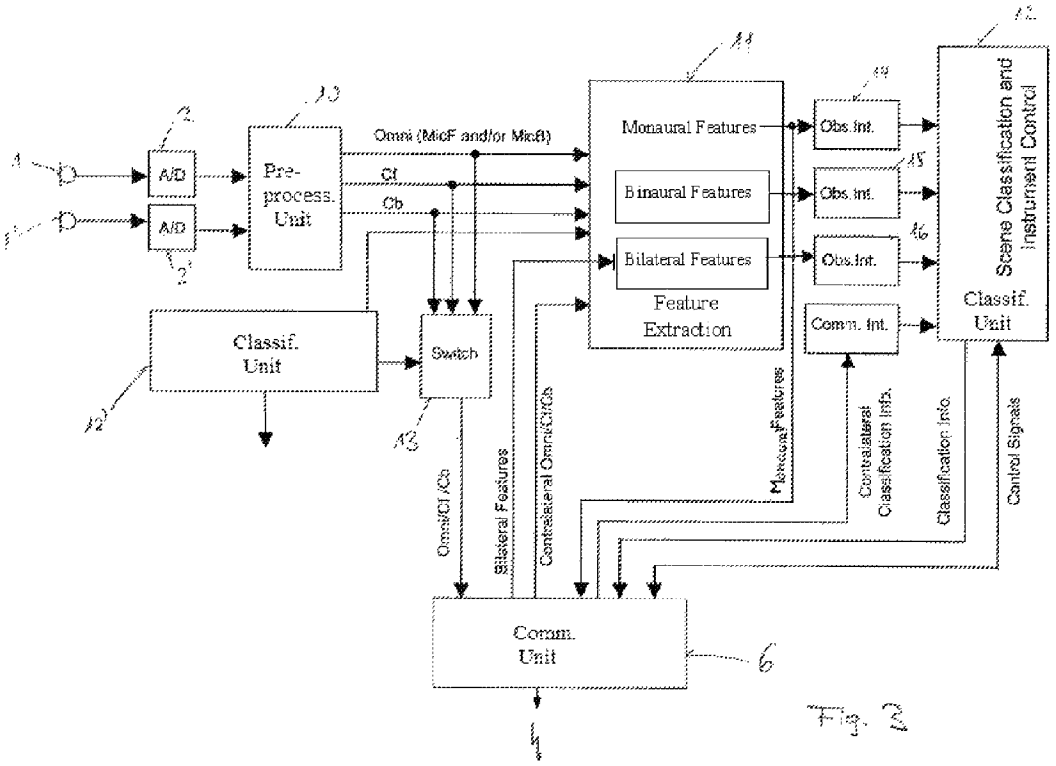

FIG. 2 shows a block diagram of a further embodiment of the present invention. In contrast to the embodiment of FIG. 1, the signal processing unit 3 is operationally connected to the communication unit 6 via a classifier unit 8. Furthermore, the output of the analog-to-digital converter 2 is fed to the classifier unit 8 as well as to the signal processing unit 3. The detection unit 7, which is operationally connected to the communication unit 6, as is the case for the embodiment of FIG. 1, is now directly connected to the classifier unit 8 and not directly to the signal processing unit 3 as is the case for the embodiment depicted in FIG. 1.

The structure of the embodiment of FIG. 2 opens up the possibility of selecting an operating mode not only in dependence on the quality of the communication link but also in dependence on the output of the classifier unit 8 which is used, for example, for determining the momentary acoustic scene with which the hearing system user is confronted.

In FIG. 3, a block diagram of yet another embodiment of the present invention is depicted. Again, a binaural hearing system is used as a framework comprising two hearing devices, each having two microphones. However, the ideas explained in connection with this embodiment are applicable also to hearing systems with more than two hearing devices and more than two microphones in each of the hearing devices.

As in FIGS. 1 and 2, FIG. 3 partly shows one of the hearing devices (either left or right) of the hearing system. The contra-lateral hearing device is of the same structure and performs the same functions as the ipsi-lateral hearing device depicted in FIG. 3. The hearing device has a front microphone 1 and a back microphone 1' that convert acoustic signals into corresponding electrical signals, which are converted into digital signals by the analog-to-digital converters 2 and 2', respectively. Down the signal path, a preprocessing unit 10, a feature extraction unit 11 and a classification unit 12 are provided.

The signals of the front and back microphones 1 and 1' are subject to front-end signal processing in the preprocessing unit 10, which might include filtering, clipping, dynamic range adjustment or others. The front-end processing performed in the preprocessing unit 10 also includes a processing block for monaural beamforming that outputs a front cardioid signal Cf and a back cardioid signal Cb. From the two acoustic signals picked up by the microphones 1 and 1', one is selected as omni-directional signal by the preprocessing unit 10. In the embodiment depicted in FIG. 3, a switching unit 13 is provided in order to select one of the cardioid signals Cf, Cb or one of the omni-directional signals (front or back). The selected signal is transmitted to the contra-lateral hearing device (not shown in FIG. 3) via the communication unit 6.

In a further embodiment of the present invention, in which a larger link capacity is available for the communication link than for the one described above, two or more audio signals are transmitted to the corresponding contra-lateral hearing device for a more robust classification. For such an embodiment, the switch unit 13 is not necessary.

The omni-directional and the two cardioid signals Omni, Cf and Cb are fed to the feature extraction unit 11 for extraction of monaural signal features. The omni-directional signal Omni might include both omni-directional signals, i.e. the omni-directional signal from the front microphone 1 and the omni-directional signal from the back microphone 1', but this is usually not necessary for feature extraction since omni-directional front and back signals are close to each other. However, it is preferable to use the front cardioid signal Cf and the back cardioid signal Cb for the extraction of features relating to front and back hemisphere sound fields.

Some of the monaural features obtained in the ipsi-lateral hearing device are transmitted to the contra-lateral hearing device and vice versa. Such features are referred to as bilateral features when monaural features obtained in both hearing devices are exchanged between the hearing devices via the communication link and used in addition to the local signals and features obtained in each hearing device. The feature extraction unit 11 accepts also the contra-lateral bilateral features as well as the contra-lateral audio signals picked up in the contra-lateral hearing device. The contra-lateral audio signals are used together with the ipsi-lateral signals (either one or more of the omni-directional signals Omni, the front cardioid signal Cf and/or the back cardioid signal Cb) to derive the binaural features.

The features are computed and averaged over a certain time span (i.e. observation interval) in observation units 14 to 16. Therefore, the feature extraction unit 11 is operationally connected to the classification unit 12 via the observation unit 14 to 16. The classification unit 12 controls the binaural hearing system based on a momentary acoustic scene. For this, the classification unit 12, 12' comprises a sound classifier and generates required control signals, hence forms the intelligent part of the binaural hearing system. The classification unit is represented by two building blocks 12 and 12' in FIG. 3. A realization of the classification unit 12, 12' or any other unit by two or more building blocks is within the meaning of the present invention.

The classification unit 12, 12' determines the momentary acoustic scene either from a discrete set of scenes or based on a continuous mapping from features to acoustic scenes, the latter principle is generally known under the term "class decision". The classification unit 12, 12' also incorporates the information (mostly from the communication unit 6) regarding the quality of the communication link into the decision process. Therefore, the detection unit 7 (FIGS. 1 and 2) is incorporated into the classification unit 12, 12' and is not reflected by an own building block as it is the case for the embodiments depicted in FIGS. 1 and 2.

Depending on the availability of signals and features over the communication link, and depending on the quality of the communication link, an operational mode is to be selected for the classifier, and accordingly for the binaural hearing system as a whole. In FIG. 3, a classifier works in one of the following modes:

1. Monaural operating mode: The classifier uses the monaural features only. This results in a monaural classification decision and the binaural hearing system switches to an appropriate algorithm. This is the operational mode to choose when the binaural link is broken, too noisy, or if the capacity of the link does not permit to exchange signals, features, or class decisions with sufficient reliability.
2. Bilateral operating mode: The classifier uses the monaural and bilateral features, or exchanges class decisions. Even when the left and right hearing devices operate independently but every now and then exchange information, the classifier is in the bilateral mode because it continuously has to exchange some information with its counterpart at the opposite side. Note that bilateral features provide some form of binaural information when the left and right sides are considered together, e.g., for a crude form of localization of sounds. This can be useful in the case when the binaural features cannot be computed when the capacity of the communication link does not permit to transmit an audio signal for computation of binaural features, but only permits transmission of features, which require a lower transmission rate than that needed for audio signals.
3. Binaural operating mode: The classifier uses the monaural, bilateral and binaural features as well as class decisions.

The above three items will be referred to as monaural classification, bilateral classification (of monaural and bilateral features), and binaural classification (of monaural, bilateral and binaural features), respectively. In summary, the degree of sophistication for the hearing system is dependent on the quality of the communication link. The better the quality of the communication link is, the more information can be transmitted and, therefore, each hearing device of the hearing system can take into consideration more information, which enables the hearing system to adapt more precisely to the momentary situation.

Associated with the respective modes of the classifier, the communication link is used for:

1. Synchronization of hearing device states, e.g. the ipsi-lateral hearing device informs the contra-lateral hearing device about the identified sound class and vice versa.
2. Exchanging computed (bilateral) features; decision-making is now more complicated than in the case where only the sound class decision is being exchanged.
3. Obtaining a contra-lateral audio signal in order to compute binaural features.

For the calculation of binaural features, if the type of the acoustic signals from the ipsi-lateral hearing device and the contra-lateral hearing device are the same, for instance, the ipsi- and contra-lateral front cardioid signals Cf are the same for both hearing devices. Therefore, the result of the binaural feature computation will be the same at both sides, unless the transmission causes significant distortion of the transmitted signals. In a further embodiment of the present invention, the binaural features are only computed in one of the hearing devices. The result of the computation is then transmitted to the contra-lateral hearing device. Such a mode is called master-slave mode, the master hearing device being the one in which the computation is performed. An advantage of such an implementation is an overall power saving since only one computation must be done.

However, if for instance the contra-lateral front cardioid signal Cf and the ipsi-lateral omni-directional signal Omni as well as the ipsi-lateral front cardioid signal Cf and the ipsi-lateral back cardioid signal Cb are used, the signals needed for the computation will not be the same for the left and right hearing device; neither will the value of the binaural features. In such a configuration, the master-slave mode is not suitable.

According to the classification decisions from both hearing devices, the classification unit 12 enables or disables, respectively, hearing device processing units and assigns appropriate parameters using, for example, a look-up table, which is referred to as the switching table. Each entry in the switching table is a state of the binaural hearing system and indicates exactly which units of the hearing devices are to be turned on and what parameters must be used. The operation of the hearing devices is quite similar to a state machine.

In a further embodiment of the present invention, it is desired that the transition from one state to another be done smoothly instead of abruptly. Therefore, a parameter-smoothing algorithm is applied to achieve soft switching.

The classification unit 12, 12' in each hearing device must know (except in some modes) what the other side knows, so they should be in synchrony via the communication link for a flawless binaural operation. However, in case the communication link is weak or even lost, the binaural hearing system must be able to support the hearing system user in the best possible way it can. This is achieved by selecting the monaural mode for the hearing system in such a case. If the communication link is operational, and the momentary acoustic scene only requires monaural signal processing, the classification unit 12, 12' can be set to a pager mode, where binaural information is exchanged only intermittently for the purpose of saving power, as done in paging systems that operate with a very low active communication duty cycle. In this mode of operation, one side has to probe the other side by exchanging control parameters, bilateral features and audio signals once in a while, so that they can switch to a binaural mode when the momentary acoustic scene changes. It must be noted that if audio signals are not exchanged once in a while in the listening mode, there is a possibility that the hearing device (or hearing system) cannot switch to a particular state when the class associated with that state can only be identified using binaural features (as well as monaural and bilateral features). Thus, the pager mode requires the communication link to be on effectively at all times, even though the probing is performed in longer intervals. Otherwise automatic switching between monaural signal processing and binaural signal processing cannot be achieved.

As for the states of the hearing devices, there are basically two modes: the-same-state mode and the different-state mode, where left and right hearing devices operate in the same state, or in different states, respectively. For instance, while a diffuse momentary acoustic scene without any significant speech sources might require the-same-state mode, an in-car situation might require a different-state mode. A different-state mode might include:

1. Better-ear approach: In the case that we do not benefit from processing signals from both sides, we can feed the audio signal or the receiver signal (output of the hearing system) of the hearing device picking up the more relevant audio information to the contra-lateral hearing device at the other ear through the binaural link.

2. Independent operation: The hearing devices run freely in different states using monaural classification most of the time in a pager mode exchanging binaural information in certain intervals.

The above two modes might suggest symmetric and asymmetric acoustic scenes. However, it is preferred to reserve these terms to describe acoustic scenes rather than the operation of the hearing system. In a concert hall, for example, the acoustic field is symmetric but for the sake of saving power it is preferred to operate the two hearing devices freely instead of binaurally. Thus, the hearing device might operate in different-state modes even though the momentary acoustic scene is symmetric.

Due to electro-magnetic interference (EMI), a noise and interference related performance loss of the communication link is expected. Furthermore, the communication link might also go down totally due to severe EMI, low battery, etc., or due to weak battery power, the channel can start to become very erroneous and it can start to constantly switch between being on and off. Thus, a crucial component for the stable and robust operation of a binaural hearing system is, beside the different signal processing algorithms, a control circuitry that monitors the quality of the communication link. This information can be used to decide which data is to be transmitted over the communication link in each operating mode.

Using certain indicators from the received signal at the communication unit 6 (FIGS. 1 to 3) or the detection unit 7 (FIGS. 1 and 2), detection of the communication link quality can be performed. Then, the communication unit 6 or the detection unit 7 can convey this information to the classification unit 12' (FIG. 3) or the signal processing unit 3 (FIGS. 1 and 2). Based on a decision from the classification unit 12, 12' or the signal processing unit 3, the binaural hearing system can switch modes. A graceful degradation can be achieved if the switched mode is designed in such a manner that the difference in listening performance between the switched modes is minimal.

In a further embodiment of the present invention, there are several transitional modes between the previous operating mode and the present operating mode so that the transition is softer (soft-switching). There is a limit to the gracefulness of the degradation that can be achieved, since the benefit due to the binaural processing will have been lost in the case of a poor communication link.

There are several indicators that can be used to obtain a measure for the quality of the communication link. For example, one or a combination of the following measures for the determination of the communication link quality can be used:

1. Received signal strength indicator (RSSI) in the radio part of the communication unit 6;
2. Signal-to-noise ratio (SNR)/signal-to-interference-plus-noise ratio (SINR)/signal-to-interference ratio (SIR) averaged over at least a transmitted data packet;
3. Channel state information (CSI) estimation typically a short-term estimate on a "bit-by-bit" basis;
4. Bit error rate (BER)/block error rate (BLER)/frame error rate (FER)/packet delivery ratio (PDR) determination, e.g. based on a "decode, re-encode and compare" procedure or on assessing CRC (cyclic redundancy check) failures either over a single or several data packets;
5. Outliers in the audio signal waveform, which might indicate either signal outages or interference bursts;
6. Use of any information available on the error behaviour of the source or channel decoding scheme, e.g. Euclidean distance or trellis path evaluation for the latter;
7. Any form of synchronization indicator such as delay-locked loop (DLL) update rate, phase-locked loop (PLL) lock indicator or frame synchronization indicator.

Regarding above items 1, 2 & 4 see for instance Vlavianos et al. "Assessing Link Quality in IEEE 802.11 Wireless Networks: Which is the right metric?" in Proc. IEEE PIMRC, Sep. 15-18, 2008, Cannes, France. Further information pertaining to items 2, 4 & 6 can be found for example in Gunreben et al. "On link quality estimation for 3G wireless communication networks" in Proc. IEEE VTC, Sep. 24-28, 2000, Boston, Mass., vol. 2, pp. 530-535.

A binaural hearing system must switch to a fallback option called, for example, "link-down mode" when the communication link goes totally down. Classification performance certainly degrades in case of a link-down if the acoustic scene changes while the communication link is down and binaural or bilateral information is necessary for the new acoustic scene to be detected. Otherwise, a safe fallback strategy is to assume that the acoustic scene does not change as far as the monaural classification cannot detect any considerable change in signal characteristics, even though a binaural classifier might detect the change. If the new acoustic scene does not require binaural or bilateral information, there might be almost no degradation since monaural classification is always available. The same graceful transition—in this case, an up-grade—strategy is applied in the "link-up mode", i.e. when the communication link is re-established after being down.

What is claimed is:

1. A hearing device comprising:

at least one microphone;

at least one analog-to-digital converter;

a signal processing unit;

and a detection unit adapted for determining a quality of a wired or wireless signal communication link established and/or maintained between the hearing device and a further hearing device, wherein the at least one microphone is operationally connected to the signal processing unit via the at least one analog-to-digital converter, and wherein the signal processing unit is configured to select an audio signal processing scheme in accordance with the quality of the communication link determined by the detection unit, and wherein the hearing device determines a momentary acoustic scene, and wherein an operational mode of the hearing device is selectable dependent on the quality of the communication link quality determined by the detection unit, and the audio signal processing scheme is further selectable in accordance with the momentary acoustic scene determined.

2. The hearing device of claim 1, characterized in that the detection unit (7) selects one of the following operating modes for the audio signal processing scheme:

monaural operating mode;

bilateral operating mode; and binaural operating mode.

3. The hearing device of claim 1, wherein a switch is provided for selecting one or more of the ipsi-lateral signals to be transmitted to the further hearing device.

4. A binaural hearing system comprising two of the hearing devices according to claim 1, wherein the hearing devices are able to communicate with each other via-the communication link.

5. The hearing device according to claim 1, wherein the detection unit provides information to the processing unit indicating the quality of the communication link determined.

6. The hearing device according to claim 1, wherein the detection unit provides information indicating the quality of the communication link determined.

7. The hearing device of claim 1, wherein the hearing device is operable in either one of the following operating modes:

monaural operating mode, wherein only monaural features are used;

bilateral operating mode, wherein both monaural and bilateral features are used, or class decisions are exchanged; and binaural operating mode, wherein monaural, bilateral and binaural features are used as well as class decisions are exchanged.

8. The hearing device of claim 1, wherein either one of monaural, bilateral and binaural features is provided to the hearing device in dependence of the quality of the communication link determined.

9. A method to operate a binaural hearing system having two hearing devices, the method comprising:

determining the quality of a communication link to be established or maintained, respectively, between the two hearing devices;

determining a momentary acoustic scene, wherein an operational mode of the hearing devices is selected dependent on the quality of the communication link determined; and adjusting an audio signal processing scheme in the hearing system in accordance with the quality of the communication link and in accordance with the determined momentary acoustic scene.

10. The method of claim 9, wherein the quality of the communication link is being determined by one or more of the following procedures:

determining a received signal strength indicator in a radio part of one of the two hearing devices;

determining an averaged signal-to-noise ratio over at least a transmitted data packet;

determining a bit error rate based on a decode, re-encode and compare procedure;

determining outliers in a received audio signal waveform;

determining a delay-locked loop update rate; and determining a status of a phase-locked loop or any other form of synchronization indicator.

11. The method of claim 9, wherein one of the following operating modes is selected for the audio signal processing scheme:

monaural operating mode;

bilateral operating mode; and binaural operating mode.

12. The method of claim 11, wherein the monaural operating mode is selected if the communication link is interrupted;

the bilateral operating mode is selected if the communication link only allows information exchange with a reduced data rate between the hearing devices; and the binaural operating mode is selected if a full information exchange is possible between the hearing devices.

13. The method of claim 9, wherein the step of determining a momentary acoustic scene comprises feature extraction providing either one of monaural, bilateral and binaural features in dependence of the quality of the communication link determined.

14. The method of claim 9, wherein the hearing device is operable in either one of the following operating modes:

monaural operating mode, wherein only monaural features are used;

bilateral operating mode, wherein both monaural and bilateral features are used, or class decisions are exchanged; and binaural operating mode, wherein monaural, bilateral and binaural features are used as well as class decisions are exchanged.

* * * * *